US007555827B2

(12) United States Patent
Pozzobon et al.

(10) Patent No.: US 7,555,827 B2
(45) Date of Patent: Jul. 7, 2009

(54) MANUFACTURING CODED ANTENNA

(76) Inventors: Frank Pozzobon, 302 Maltby Road East, Guelph, Ontario (CA) N1L 1G4; Paul R. MacPherson, 1010 Duchess Avenue, British Columbia, Ontario (CA) V7T 1G9

( * ) Notice: Subject to any disclaimer, the term of this patent is extended or adjusted under 35 U.S.C. 154(b) by 0 days.

(21) Appl. No.: 11/774,057

(22) Filed: Jul. 6, 2007

(65) Prior Publication Data

US 2008/0010810 A1 Jan. 17, 2008

Related U.S. Application Data

(62) Division of application No. 10/900,178, filed on Jul. 28, 2004, now Pat. No. 7,242,367.

(51) Int. Cl.
*H01P 11/00* (2006.01)

(52) U.S. Cl. ..... 29/600; 29/606; 343/900

(58) Field of Classification Search ..... 29/825, 29/831, 600, 601; 333/162; 343/900, 906, 343/702, 895; 445/29, 49
See application file for complete search history.

(56) References Cited

U.S. PATENT DOCUMENTS

| | | | | | |
|---|---|---|---|---|---|
| 4,163,981 | A * | 8/1979 | Wilson | 343/715 |
| 4,259,672 | A * | 3/1981 | Newcomb | 343/722 |
| 4,300,140 | A * | 11/1981 | Brandigampola | 343/873 |
| 4,567,487 | A * | 1/1986 | Creaser, Jr. | 343/900 |
| 4,730,195 | A * | 3/1988 | Phillips et al. | 343/792 |
| 4,849,767 | A * | 7/1989 | Naitou | 343/745 |
| 4,914,450 | A * | 4/1990 | Dilley et al. | 343/895 |
| 5,357,261 | A * | 10/1994 | Brandigampola | 343/900 |
| 5,812,097 | A * | 9/1998 | Maldonado | 343/790 |
| 5,914,689 | A * | 6/1999 | Cockson | 343/702 |
| 6,181,049 | B1 * | 1/2001 | Streckert et al. | 310/306 |
| 6,211,828 | B1 * | 4/2001 | Krylov et al. | 343/702 |
| 2005/0251140 | A1 * | 11/2005 | Shaolian et al. | 606/61 |

* cited by examiner

*Primary Examiner*—Minh Trinh

(57) ABSTRACT

A method of producing a whip antenna by tapering a length of aluminium tube and applying high velocity plasma to the aluminium tube. A ribbon conductor is also wound with a plurality of selected number of turns along the aluminium tube. A polymer coating is also applied to the antenna.

10 Claims, 6 Drawing Sheets

MANUFACTURING CODED ANTENNA

This application is a divisional of U.S. patent application Ser. No. 10/900,178 filed on Jul. 28, 2004.

FIELD OF INVENTION

This invention relates to a method for producing a whip antenna.

BACKGROUND OF THE INVENTION

Free standing or whip antennae generally comprise of an upstanding tapered length presenting a base at the bottom end thereof and a free end at the upper end. Such base antennas are used to receive and transmit signals and may be located on land or a ship.

Various attempts have heretofore been made in the prior art in order to strengthen the whip antennas that can be subjected to severe weather conditions in terms of wind or snow blowing.

For example U.S. Pat. No. 3,725,944 illustrates an antenna constructed exclusively of fibreglass with the sole exception of the electrical conductors, couplings, and upper and lower ends, which may incorporate fibreglass or some other materials.

Also U.S. Pat. No. 4,500,888 teaches a free standing antenna formed with an elongated tubular body portion having one or more sections and an enlarged base portion at its lower end for mounting thereof, and the body portion having a plurality of layers of reinforcing filaments some of the layers being bundles of longitudinal filament rovings running lengthwise, and other of the layers being generally circumferential windings of filament rovings, the layers being bonded together by resin material; electrically conducted materials embedded in the tubular structure and running from end to end, an annual electrically conductive collar connected to the conductive elements adjacent the lower end of the structure, a female threaded socket connected to the collar, and extending through a wall of the tubular structure for connection from the exterior, at least one layer of the woven reinforcing filament cloth material extending up the interior of the tubular structure adjacent the lower end, and overlying the interior of the collar, and, resin bonding the layer of woven cloth material to the interior of the tubular structure, and to the interior of the collar.

Furthermore U.S. Pat. No. 5,357,261 illustrates a whip antenna having a base member being formed of glass fibres reinforced resin materials.

Other arrangements of free standing antennas are shown in U.S. Pat. No. 4,914,450 which shows a flat ribbon-like conductor which is wound around a fibre glass rod.

U.S. Pat. No. 4,214,247 relates to a turnable fibreglass whip antenna comprising an elongated fibreglass core having a conductive wire coiled around the core and serving as the antenna. The upper most extremity of the wire is tightly coiled around an axial bore within the fibreglass. A metal insert, fixed within the fibreglass bore is in threaded engagement with a setscrew accessible from the top of the antenna.

Furthermore, U.S. Pat. No. 4,161,737 shows a stepped, tapered helical antenna having tightly wound loading coils between each of the different helical sections, and the loading coils are wound in a stepped, tapered mathematical progression.

Furthermore, some prior art whip antennas need to be operated in pairs aboard a ship or on land in order to extend the operation frequency range required in operation as shown in Canadian Patent No. 2, 114, 661.

It is an object of this invention relates to a method of producing a whip antenna comprising: tapering a length of aluminium tube, applying a high velocity plasma coating, having a nickel based alloy powder, applying a winding a ribbon conductor with a plurality with a selected number of turns along said tube, and applying a layer of polymer coating.

The features of the invention shall now be described in relation to the follow drawings:

DRAWINGS

FIGS. 1, 1(*a*) and 1(*b*) are exploded schematic views of the whip antenna.

FIG. 2 is a side elevational view of the upper tube.

FIGS. 3*a* and 3*b* are top and sectional views of the corona ball.

FIG. 4 is a side elevational view of the upper section assembly.

FIG. 5*a* is a top plan view of the upper plug insulator.

FIG. 5*b* is a cross sectional view taken along the line A-A of FIG. 5*a*.

FIG. 6*a* is a side elevational view of the male contact.

FIG. 6*b* is an end view of FIG. 6*a*.

FIG. 7*a* is an end view of the joint sleeve.

FIG. 7*b* is a cross sectional view taken along the line A-A of FIG. 7*a*.

Figure 11A:
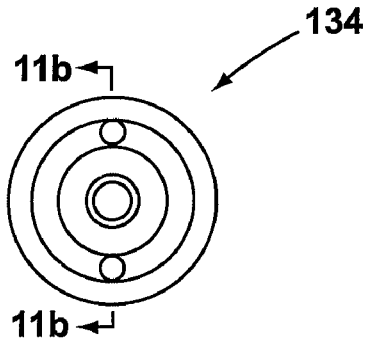

FIG. 11*a* shows the lower plug contact insulator.

Figure 11B:
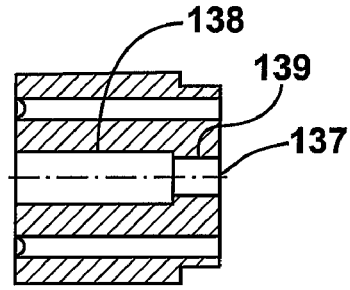

FIG. 11*b* is a cross section taken along the line A-A of FIG. 11*a*.

Figure 12A:
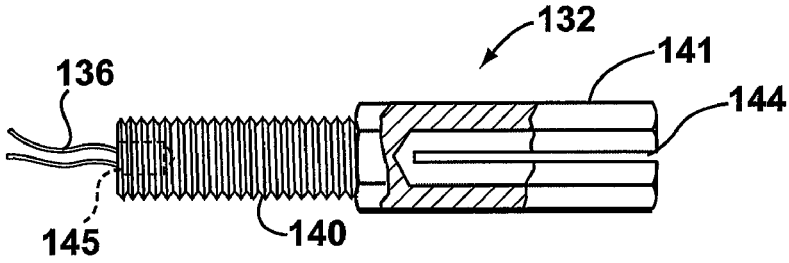

FIG. 12*a* is a partial cross sectional view of the lower female contact.

Figure 12B:
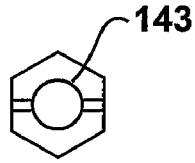

FIG. 12*b* is an end view of FIG. 12*a*.

Figure 13A:
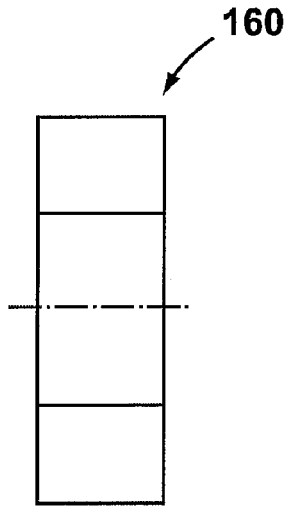
Figure 13B:
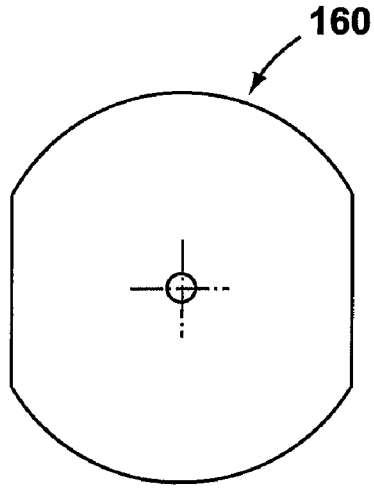

FIGS. 13*a* and 13*b* are side and top plan views of the spacer plate.

Figure 14A:
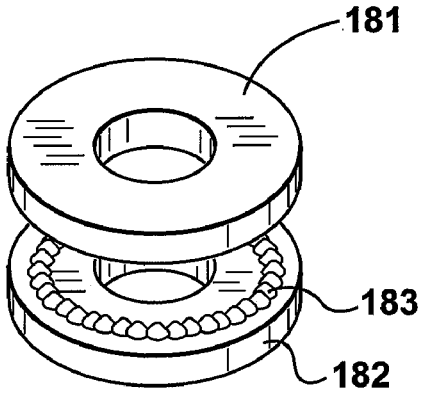

FIG. 14*a* is a partial assembly drawing of the transformer.

Figure 14B:
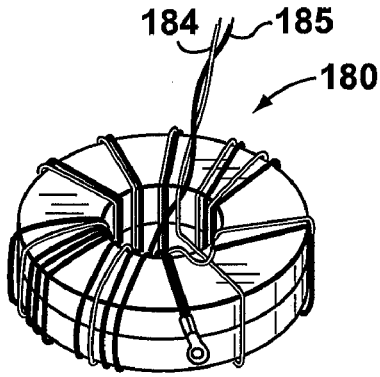

FIG. 14*b* is a perspective view of the transformer.

Figure 14C:
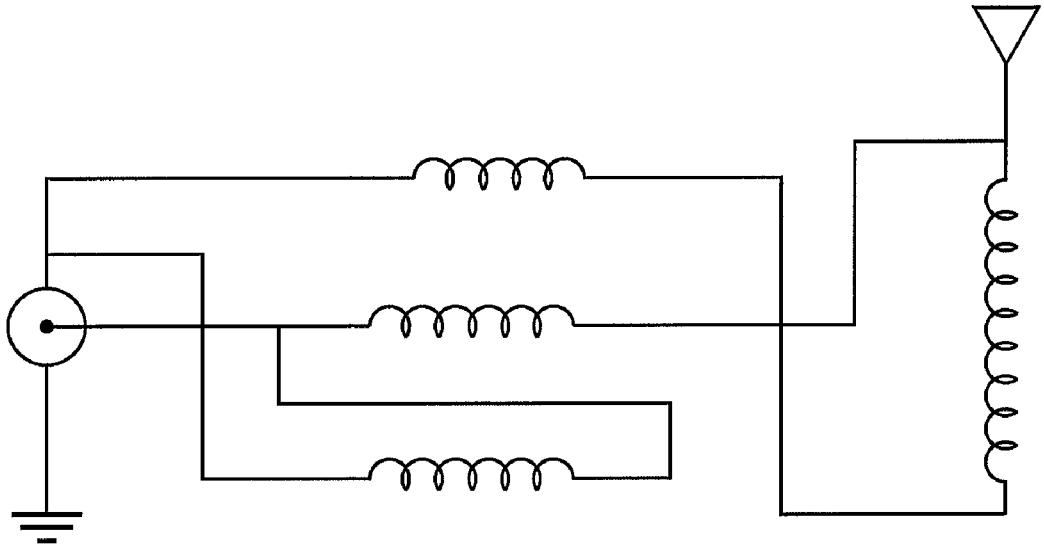

FIG. 14*c* is a schematic view of the transformer.

DETAILED DESCRIPTION OF THE INVENTION

Like parts will be given like numbers throughout the figures. The drawings are not necessarily to scale.

Figure 1:
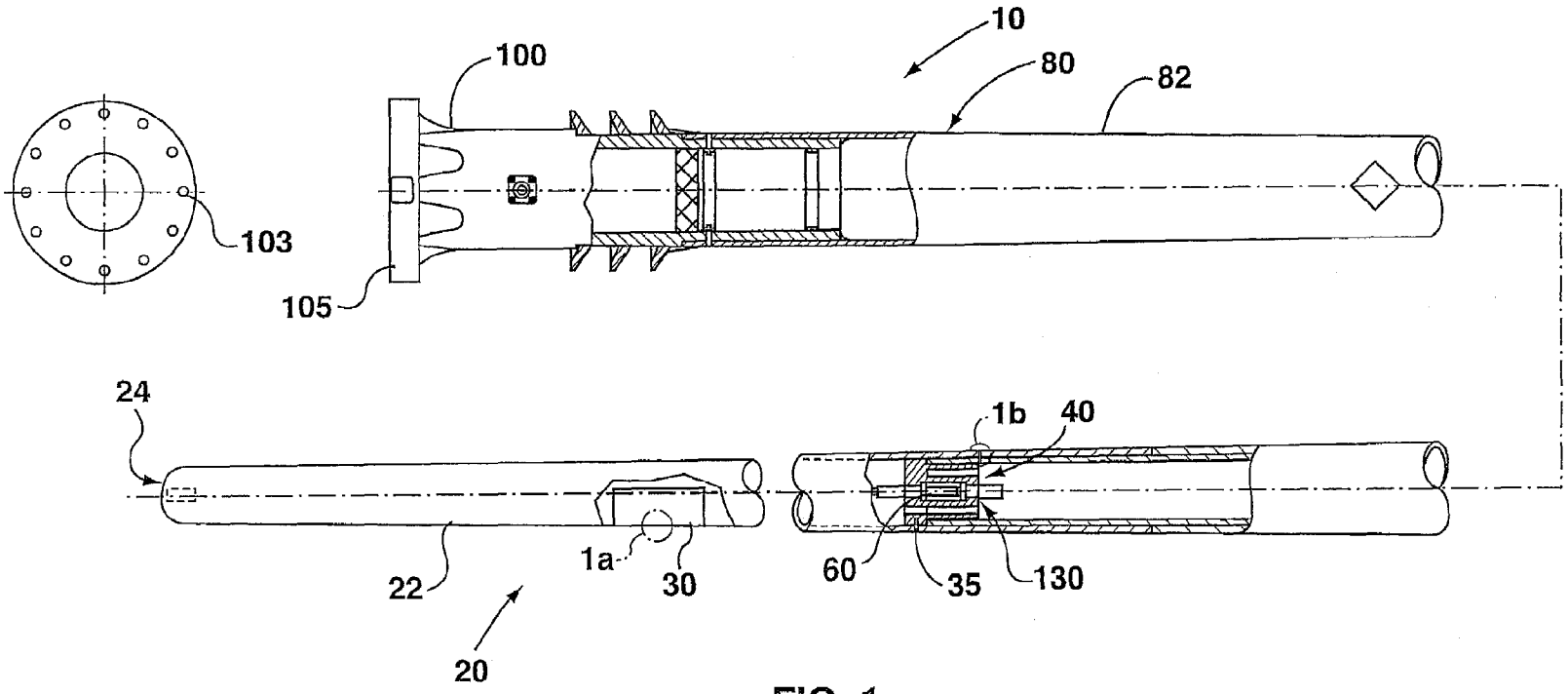
Figure 1B:
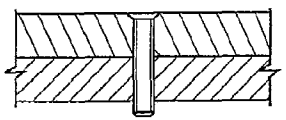
Figure 1A:
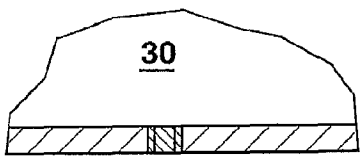
Figure 2:
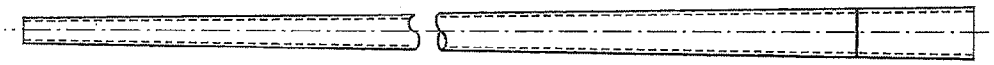

FIG. 1 is an exploded schematic view of the invention showing the whip antenna 10 comprising an upper section 20 and a lower section 80. The upper section assembly 20 generally consists of a tapered aluminium tube 22, corona ball 24, vibration damper 30, internal wiring 40 and an insulated plug style contact 60.

Figure 4:
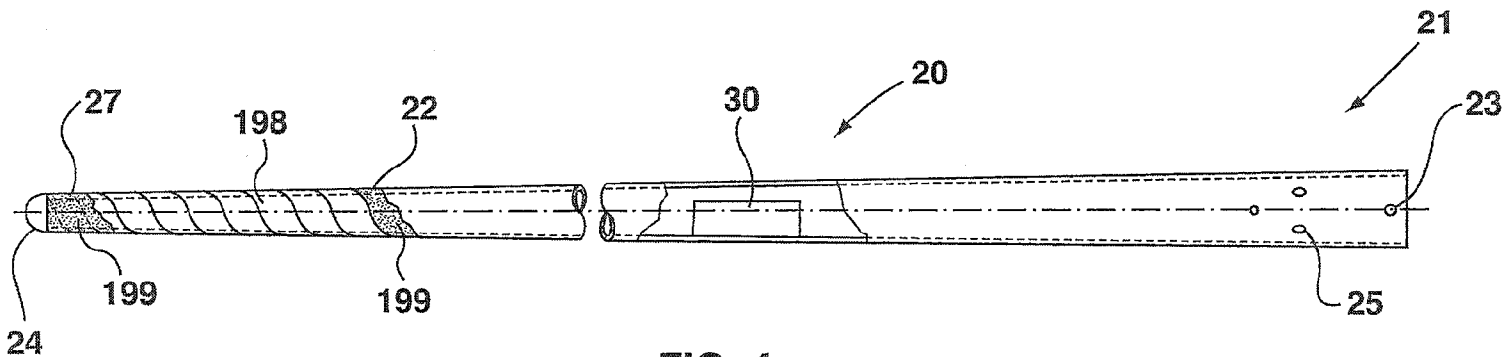
Figure 5B:
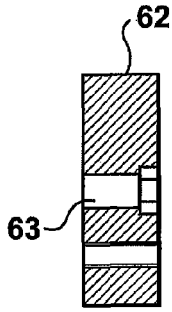
Figure 5A:
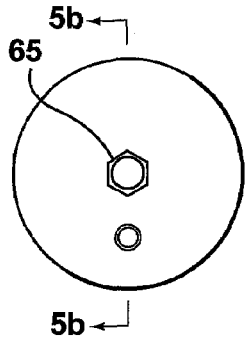

Although the invention is described in relation to an aluminium tube any suitable material such as metal, could be utilized. The aluminium tube 20 is cut to a desired length and tapered using a spinning method and heat treated in order to impart the desired strength and flexing characteristics. The outside surface of the aluminium tube 22 is rotary sanded to a desired smoothness. As shown in FIG. 4 any number of holes can be drilled through the bottom end 21 of the aluminium tube 22. As shown four holes 23 are drilled and countersunk equally spaced around the circumference of the tube 21. A further four holes 25 are drilled and countersunk equally spaced around the circumference of the tube 22 and off set from the first four holes by 45 degrees.

Figure 3B:
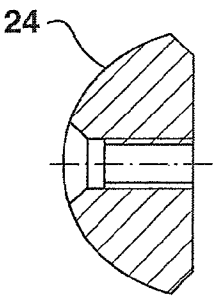
Figure 3A:
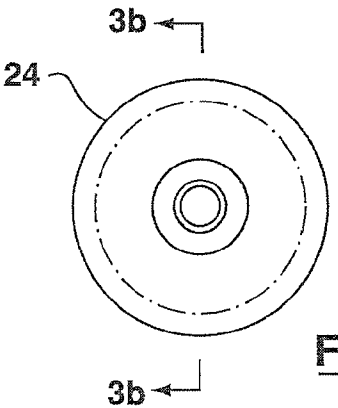

The corona ball 24 may be machined from a round aluminium bar stock as shown in FIG. 3*b* and then welded to the top of the tapered tube 27 all the way around and ground flush. A vibration damper 30 is connected to the inside of the aluminium tube 22 as shown in FIG. 4 and filled with lead shot. The vibration damper is disposed off center from the inside of the hollow tube 22 so as to discourage the generation of a periodic vibration of the antenna which could otherwise be generated as a standard wave due to the influence of weather conditions, such as the wind or rocking action of a ship.

The upper plug contact 60 is comprised of three components: the male contact 61, an insulator 62 and internal wiring 63.

Figure 6A:
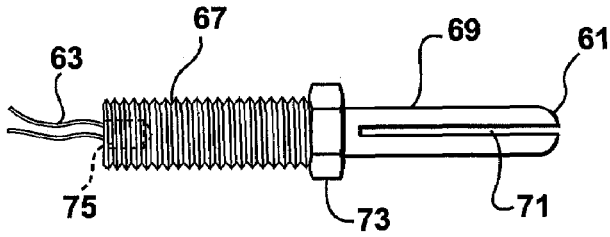
Figure 6B:
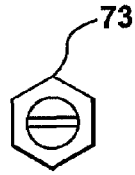

The insulator 62 may be produced by a variety of methods including machining the insulator 62 from a round nylon bar so as to produce a counter sunk bore 63 having a hexagonal recess 65. The male contact 61 may also be produced by a variety of methods including machining the male contact 61 from a hexagonal brass bar to the configuration show in FIGS. 6*a* and 6*b*. In particular the male contact 61 has a threaded portion 67 and a generally rounded cylindrical section 69 with a slot 71 running there through. The male contact 61 fits into the insulator 62 as shown in FIG. 1 and fastened thereto by a nut (not shown). More specifically the hexagonal raised portion 73 of the male connector 61 fits into the recess 65. Two wires 63 are stripped and soldered into the solder cup 75 of the male contact 61 using for example high temperature solder. Although the invention has been described in relation to a nylon insulator 62 and brass male contact 61 any variety of suitable materials such as insulating material or metallic material may be used.

The upper plug contact assembly 60 may then be inserted into the upper tube 22 as shown in FIG. 1. One such assembly for example can consist of drilling three holes 35 countersunk into the tube 22 equally spaced around the circumference of the tube near the bottom 21. Furthermore two more holes can be drilled into the tube 22 equally spaced around the circumference above the previous three holes 35. The wires 63 can then be fed through the two holes while the upper plug contact assembly 60 is inserted into the tube until it is centered under the three countersunk holes. The insulator 62 can then be drilled and taped using the three countersunk holes as a guide and the whole assembly 60 screwed into place using these three taped holes. The loose ends of the wires 63 can then be stripped and inserted through copper button contacts, then soldered. The button contacts are fastened into the two holes drilled into the tube.

The lower section assembly 80 consists of a tapered metallic tube such as aluminium 82 joint sleeve 90, fibre glass base insulator assembly 100, internal wiring 110 and an lower insulated plug style contact 130.

The tapered aluminium tube 82 can be produced by a variety of methods including cutting an aluminium tube to length and tapering it using a spinning method and heat treating same to desired specifications of strength and flexibility. The outside surface of the tube 82 is rotary sanded using a selected grit sandpaper.

Figure 7A:
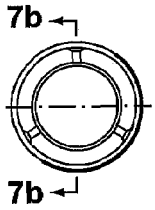
Figure 7B:
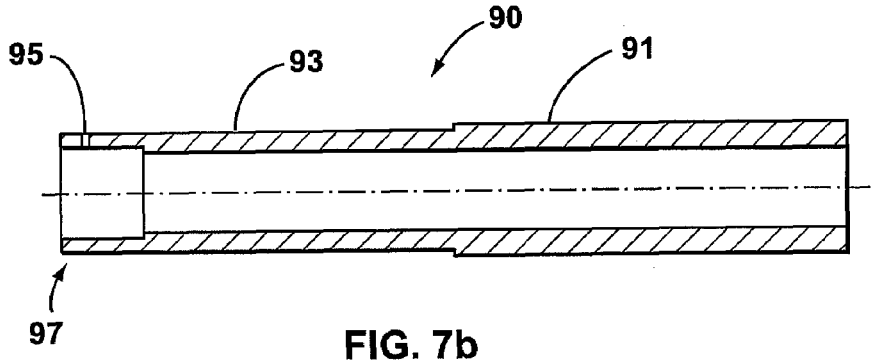
Figure 8:
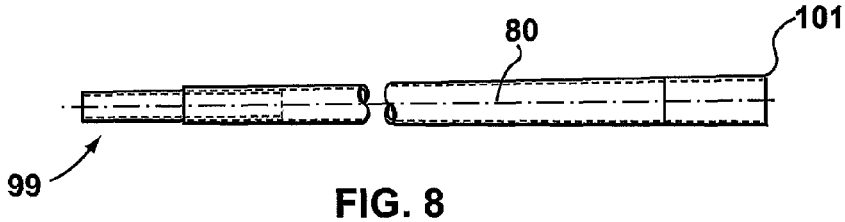
FIG. 8 is a side elevational view of the lower taped aluminium tube.

The joint sleeve 90 as shown in FIGS. 7*a* and 7*b* and can be manufactured in a variety of ways. One such manufacture includes machining a round aluminium tube stock to produce a tube having a first section 91 having a first diameter and having a second section 93 with a second diameter where the second diameter 93 is smaller than the first diameter 91. A plurality of holes, for example three holes 95, can be drilled and countersunk into the sleeve 90 equally spaced around the circumference near the top 97 of the sleeve 90. The sleeve 90 may then be inserted into the top 99 of the lower tube 80 so that a portion of the sleeve 90 extends out the top of the tube as shown in FIG. 1.

The joint sleeve 90 may then be fastened to the tube 80 such as for example welding. A number of holes, for example eight, can be drill through the exposed part of the sleeve 90 using the upper section assembly as a guide for locating the holes. The holes may then be taped for threaded inserts.

The base insulator 100 can be manufactured by a variety of ways, and in one embodiment is manufactured by winding fibreglass roving soaked with an epoxy resin over a mandrel in a manner well known by persons skilled fin the art. The fibreglass may be wound both longitudinally and circumferentially for strength. A mould may be clamped over the bottom of the base to form the flange and hole pattern for mounting, then placed in an oven until the resin cures.

After the resin cures, the base insulator 100 is machined and sanded down to a selected standard. Two step down diameters 102 and 104 are machined, one for the drip shield rings 105 and the other for the lower end 101 of lower tube 80, respectively.

In one embodiment the surfaces of the base insulator which will be exposed after final assembly, to the elements, are covered with an epoxy resin soaked, thin fibreglass cloth to create a smooth outer surface.

A drill jig (not shown) can be used to drill a selected number of holes 103 into the base flange 105. A flat and mounting hole pattern to accommodate a panel-mount LC-type connector may also be drilled and machined at this time.

A plurality of drip shield rings 105 can be manufactured in a variety of ways including utilizing resin soaked fibreglass wound over a mandrel, and clamping a mould over it as the rings 105 are cured in an oven. The drip rings may then be dimensioned so as to be concentrically mounted over step down diameter 102 and glued thereon with a suitable adhesive such as high strength epoxy glue. Spacer rings (not shown) may be installed between each drip shield 105 to separate them from each other.

Figure 9:
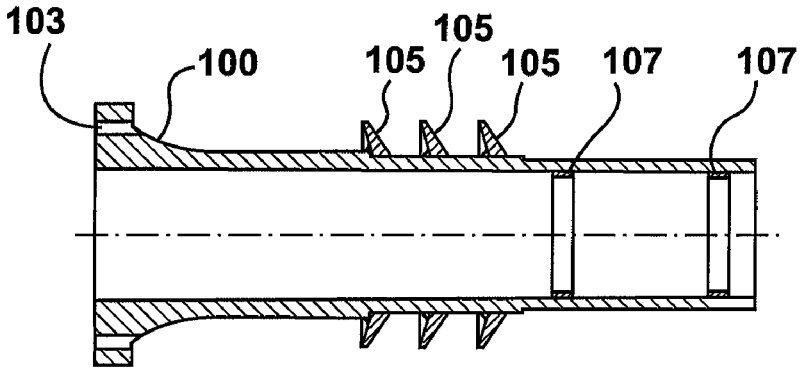
FIG. 9 is a cross sectional view of the base insulator.

A number of reinforcement rings 107 are shown in FIG. 9. The reinforcement rings 107 can be comprised of a variety of materials including metal in the embodiment shown comprised of aluminium. The rings 107 may be inserted into the base insulator 100 and glued in place using high strength epoxy glue.

The base insulator subassembly may then be slid inside the bottom 101 of lower tube 80. A number of holes may then be drilled so that they run through the wall of the tube 80, the wall of the step down 104 of the base insulator 100 and into the lower reinforcement ring 107. A number of other holes may be drilled and countersunk and tapped equally spaced around the circumference of the tube. In one embodiment these holes are rotated 90 degrees and drilled into the upper reinforcement ring 107.

The lower plug contact assembly 130 comprising three components namely the female contact 132, lower plug contact insulator 134 and internal wiring 136. As described above the contact 130 can be machined from nylon bar stock to present a bore 137 having a first diameter 138 and a second diameter 139. The second diameter 139 is smaller than the first diameter 138.

The female contact 132 may be machined from a metal bar stock such as for example brass to produce a first threaded portion 140 and a second portion 141 having a hexagonal cross section with a blind hole 143 as shown in FIGS. 12*a* and 12*b*. A slot 144 is presented by the hexagonal cross section 141. The female contact 132 fits within the insulator 134 with the threaded portion 140 registering within the second diameter 139. Female contact 132 is fastened onto the insulator 134 with a nut (not shown). Two wires 136 are stripped and soldered into the solder cup 145 of the female contact 132 using high temperature solder.

The lower contact assembly 130 may then be inserted into the lower tube 80. In one embodiment two holes may be drilled into the tube equally spaced around the circumference near the top 99. The wires 136 are fed through the two holes while the lower contact assembly 130 is inserted into the tube 80 until it stops centered under the three countersunk holes of the sleeve. The insulator 134 may be drilled and tapped using the three countersunk holes as a guide and the whole assembly is screwed into place using these three tapped holes. The loose ends of the wires 136 are stripped and inserted through copper button contacts then solders using high temperature solder. The button contacts are fastened into the two holes drilled into the tube 80.

Two additional holes may be; drilled into the lower section, one near the bottom of the base 80 and the other spaced above and in line with the first. Two wires may be cut and inserted through the holes running toward the bottom of the antenna. The loose ends of the wires (outside of the lower section) are stripped and inserted through copper button contacts then soldered using high temperature solder. The button contacts are fastened into the two holes drilled into the tube 80.

A spacer 160 comprised of polyethylene foam as shown in FIG. 13 is inserted inside the base insulator 100 to just below the bottom of the reinforcement ring. The spacer 160 is inserted so that the two loose wires are pinned within the inner wall of the lower section and the outside surface of the spacer. Silicone adhesive is used to secure the wires and spacer against movement.

Winding and Plasma Flame Coating

Generally speaking the antenna 10 and namely the upper and lower aluminium tubes 20 and 80 are cleaned then subjected to plasma coating and then coated with a polymer 199 prior to the application of a helical ribbon conductor 198 with a plurality of selected number of turns along said antenna.

More specifically the upper section assembly 20 is sanded to remove any irregularities. The button contacts are masked with teflon tape and the upper section 20 is degreased and blasted with aluminium oxide grit.

Following blasting a high velocity plasma coating is applied by preheating the section to 150 degrees Fahrenheit and applying an alloy nickel based powder. In one embodiment the plasma coating occurs within one hour after grit blasting by using argon (pressure 150 PSI, flow 38 SLM) and hydrogen (pressure 50 PSI, flow 2 SLM). In one embodiment a Metco (trademark) 480 NS alloy nickel based powder is sprayed to apply a metal ceramic coating with no particles protruding more than 2 millimeters above the general surface using Metco 9M series spray system. However, other plasma sprays may be utilized.

Within 2 hours of the plasma spraying the upper section 20 is then coated with a polymer coating 199, taped, coated again and diamond ground to a smooth finish. In one embodiment the section is coated with Metal Tee 7100 coating using a roller. The taping may comprise of teflon tape for example Ultra Temp 90 tape 0.032 thick. The button contacts are then exposed, the whole section primed with for example Rustoleum G93 Xylene and the button contacts masked over again. Another polymer coating is applied to the section and the button contacts exposed again.

Thereafter a ribbon conductor 198 which, in one example comprises of 0.120.times.0.010 inches is wound around the upper section 20 from bottom to top, with one full tern over top of both button contacts. The windings are selected so as to impart a desired frequency response. For example the windings can start with 10 turns per foot for the first 12 inches and increase by 4turns per foot every 12 inches up to a total length of 16 feet. More specifically the first 12 inches can be-wound at a rate of 10 turns per foot, the next 12 inches wound at a rate of 14 turns per foot, while the next 12 inches are wound at a rate of 18 turns per foot, all the way to the last 12 inches which are wound at a rate of 17 turns per foot. The ribbon conductor 198 is then soldered to both electrical buttons using high temperature solder.

The whole section is coated with another layer of polymer coating 199 by applying Metal Tech 7100 polymer coating with a minimum thickness of 15 mil, before wrapping a layer of fibreglass reinforcing mesh around the upper section 20 with a final polymer coating on top of the whole process. After a forty hour cure time the surface of the section is sanded smooth and the edges are ground down. The eight holes drilled into the bottom of the section 20 are re-drilled and re-countersunk to remove the plasma flame and polymer coating layers.

With respect to the lower section 80, the base insulators 100 as well as the upper portion of the joint sleeve 90 are masked off as they do not get coated. The remaining portion of the lower section 80 is then sanded down to remove any irregularities. The button contacts are masked with teflon tape and the section is then degreased and blasted with aluminium oxide grit.

Following the blasting a high velocity plasma coating is applied to the section by preheating it to 150 degrees Fahrenheit and applying the plasma spray as described above. Within two hours of the plasma coating the section is then coated with Metal Tech 7100 polymer coating, taped, coated again and diamond ground to a smooth finish. The button contacts are then exposed, the section primed with Rustoleum G93 Xylene and the button contacts are masked over again. One more polymer coating 199 is applied to the section and the button contacts are exposed again.

Again a ribbon conductor 198 is selectively wound around the section from bottom to top. By way of example starting with one full turn over top of the bottom or lower button contact, a ribbon conductor 198 (0.125.times.0.005 inches) is wound around the section from bottom to top. Again by way of example only the windings can start with 35 turns per foot for the first 12 inches with the 35 turn over top of the section button contact. The winds can decrease by 2 turns per foot every 12 inches after this, up to a total length of 16 feet. For example the first 12 inches are wound at a rate of 35 turns per foot, the next 12 inches are wound at a rate of 33turns per foot, the next 12 inches are wound at a rate of 31 turns per foot, all the way to the last 12 inches which are wound at a rate of 5 turns per foot. The last turn is wound over top of the two button contacts installed at the top of the lower section. The ribbon conductor 198 is then soldered to all four of the electrical buttons using high temperature solder.

The whole section is coated with another layer of polymer coating 199 before wrapping a layer of fibreglass reinforcing mesh around the section with a final polymer coating 199 over top of the whole process. After a 48 hour cure time, the surface of the section is sanded smooth and the edges are ground down. The eight holes drilled into the bottom of the lower section 80 are re-drilled and re-countersunk to remove the plasma flame and polymer coating layers.

Final Assembly

Two antenna sections 20 and 80 are joined together by sliding the upper section 20 over the joint sleeve 90. The complete antenna is raised onto a ground plain outside to complete the tuning of the matching transformer 180.

The matching transformer 180 is wound using a tri-filar winding of eight turns around two ferrite tororids 181 and 182, stacked and glued together as shown in FIG. 14*a* by using an adhesive 183. The output terminals 184 and 185 of the transformer 180 are connected to the two internal wires of the lower section. The input of the transformer 180 can be connected to a Network Analyser in order to measure the antenna's Voltage Standing Wave Ratio (VSWR). The windings on the transformer can be adjusted as with a silicone adhesive to prevent them from moving.

Figure 10:
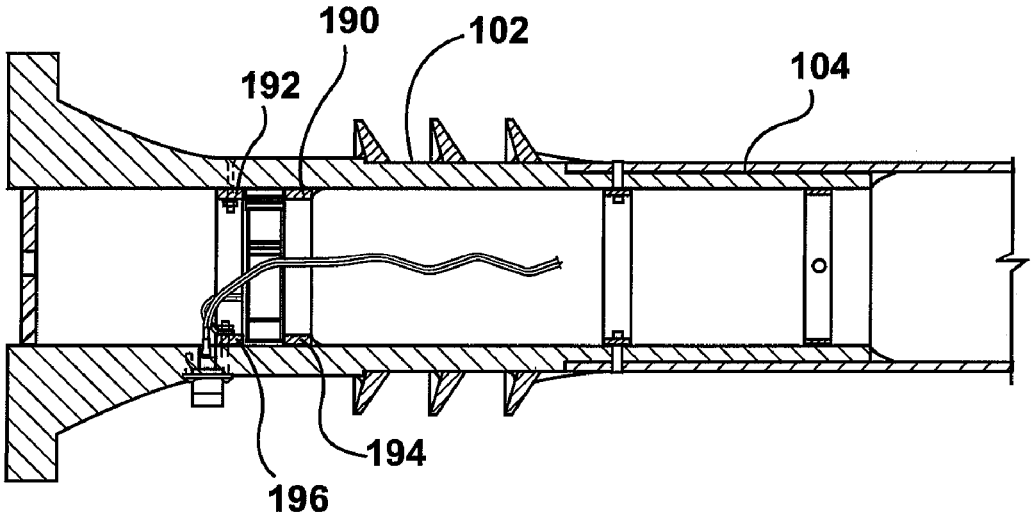
FIG. 10 is a partial view showing the base insulator connected to the lower tapered tube.

Two toroid support rings 190 and 192 as shown in FIG. 10 can be manufactured by a variety of means including winding resin soaked fibreglass strands around a mandrel. One support ring 190 is installed into the base insulator 100 by gluing it with high strength epoxy glue. A silicone rubber gasket 194 is placed next to the support ring 192 before the transformer is inserted. A second rubber gasket 196 is placed next to the transformer followed by the second support ring 192.

Using one of the upper mounting holes of the LC-connector (drilled when the base insulator was first machined) found on the side wall of the base insulator, a hole is drilled through the support ring below. A nut and bolt can be used to fasten the connector, and the support ring to the base insulator.

The invention described above comprises of a vertical radiating element tapering from the integral fibreglass base to the free end. The radiating element comprises the selective windings of inductive coils over the tapered insulated aluminium tube as described. The design of the radiating element, along with its integrated matching transformer allows the antenna to be operated substantially instantaneously at any frequency within its operating frequency band. For example the frequency band can comprise of 2 MHz to 30 MHz. The antenna as described exhibits VSWR of less than 3 to 1 across the entire operating frequency band without the need of a separate tuning device.

The antenna exhibits vertical polarization and omni-directional radiation in the azimuth plane. The LC-type connector found on the side of the antenna 10 just below the drip shield allows the antenna to be directly coupled to the transmitting or receiving equipment. Up to 5 kW of transmitting power can be applied to the antenna 10.

The fibreglass base of the antenna provides high voltage isolation between the radiating element and ground. Drip shields installed at the top of the base insulator 100 prevent high voltage spark over and corona fields from occurring between the radiating elements and ground in wet environments such as on board ships or raining weather.

Since the antenna is substantially a true broadband device, no additional tuner or coupler is necessary for operation thereby permitting replacement of other antenna systems having 2 separate whip antennas and couplers.

Furthermore since the male and female connectors were slotted they can accommodate good frictional fit and flexibility there between to maximize electrical contact.

Moreover the antenna described therein exhibits superior heat dissipating characteristics so as to substantially minimize tracking of heat seeking missiles.

The foregoing is a description of the preferred embodiments of the invention which is given here by way of example only. The invention is not to be taken as limited to any of the specific features as described, but comprehends all such variations thereof as come within the scope of the appended claims.

We claim:

1. A method for producing a whip antenna comprising:

(a) tapering a length of aluminum tube, (b) applying a metallic plasma coating, having a nickel based alloy powder, on said tube, (c) applying a layer of polymer coating on said metallic plasma coating, (d) winding a ribbon conductor with a plurality of selected number of turns on said polymer coating, (e) further wrapping a layer of fibreglass reinforcing mesh and another coat of polymer coating, thereby forming an antenna.

2. The method as claimed in claim 1, wherein said aluminum tube comprises two sections, and the sections are connected to each other.

3. The method as claimed in claim 2, wherein one section includes an insulating base and inserting a transformer therein.

4. The method as claimed in claim 3, wherein the insulating base is disposed at a lower section of said aluminum tube.

5. The method as claimed in claim 4, wherein the ribbon conductor is wound along the aluminum tube at least two different selected number of turns per unit length along said tube.

6. The method as claimed in claim 4, including the step of cleaning said aluminum tube with aluminum oxide grit prior to plasma coating.

7. The method as claimed in claim 6, wherein another coat of polymer coating is disposed on the ribbon conductor.

8. The method as claimed in claim 1 wherein the plasma coating is nickel ceramic plastic coating.

9. The method as claimed in claim 1 wherein the number of turns of ribbon can vary along with length of the whip antenna.

10. The method as claimed in claim 1 wherein the antenna operates between a frequency band between 2 MHz and 30 MHz.

* * * * *